US012691344B2

(12) United States Patent
Patterson et al.

(10) Patent No.: US 12,691,344 B2
(45) Date of Patent: Jul. 28, 2026

(54) PADDED LACROSSE STICK

(71) Applicants: Charles Colcorde Patterson, Nashville, TN (US); Philip Roger Toran, Framingham, MA (US); Anthony John Phalen, Saint-Lambert (CA)

(72) Inventors: Charles Colcorde Patterson, Nashville, TN (US); Philip Roger Toran, Framingham, MA (US); Anthony John Phalen, Saint-Lambert (CA)

( * ) Notice: Subject to any disclaimer, the term of this patent is extended or adjusted under 35 U.S.C. 154(b) by 439 days.

(21) Appl. No.: 18/467,333

(22) Filed: Sep. 14, 2023

(65) Prior Publication Data

US 2024/0390751 A1 Nov. 28, 2024

Related U.S. Application Data

(60) Provisional application No. 63/504,274, filed on May 25, 2023.

(51) Int. Cl.

| | |
|---|---|
| ***A63B 59/20*** | (2015.01) |
| ***A63B 60/54*** | (2015.01) |
| ***A63B 102/14*** | (2015.01) |

(52) U.S. Cl.

CPC ..... *A63B 59/20* (2015.10); *A63B 60/54* (2015.10); *A63B 2102/14* (2015.10)

(58) Field of Classification Search

CPC ..... A63B 59/20; A63B 2102/14

See application file for complete search history.

(56) References Cited

U.S. PATENT DOCUMENTS

| | | | | |
|---|---|---|---|---|
| 3,507,495 | A | 4/1970 | Tucker et al. | |
| 3,921,978 | A | 11/1975 | Warren | |
| 4,452,451 | A | 6/1984 | Dubreuil | |
| 5,048,843 | A * | 9/1991 | Dorfi | A63B 59/20 473/513 |
| 5,127,649 | A | 7/1992 | Carbonero | |
| 5,435,548 | A | 7/1995 | Leduke et al. | |
| 5,603,498 | A | 2/1997 | Crawford et al. | |
| 6,910,976 | B2 | 6/2005 | Tucker, Sr. | |
| 7,201,678 | B2 | 4/2007 | Filice et al. | |
| 7,344,460 | B2 | 3/2008 | Gait | |
| 7,491,141 | B1 | 2/2009 | Tucker, Sr. et al. | |
| 7,946,937 | B2 | 5/2011 | Searle | |
| 2002/0198070 | A1 * | 12/2002 | Tucker, Sr. | A63B 49/022 473/513 |
| 2014/0213394 | A1 | 7/2014 | Cholewczynski | |
| 2015/0196826 | A1 | 7/2015 | Fox et al. | |
| 2019/0321700 | A1 | 10/2019 | Hsu | |
| 2022/0161109 | A1 | 5/2022 | Plante et al. | |

* cited by examiner

*Primary Examiner* — Brian O Peters

(74) *Attorney, Agent, or Firm* — Dunlap Bennett & Ludwig PLLC

(57) ABSTRACT

A padded lacrosse stick having a flexible lacrosse shaft, and wherein the lacrosse head is substantially encased or enveloped in a head padding, and wherein a shaft padding envelopes a substantial portion of the lacrosse shaft. The padding is attached to the lacrosse head and shaft.

20 Claims, 3 Drawing Sheets

PADDED LACROSSE STICK

CROSS-REFERENCE TO RELATED APPLICATION

This application claims the benefit of priority of U.S. provisional application No. 63/504,274, filed 25 May 2023, the contents of which are herein incorporated by reference.

BACKGROUND OF THE INVENTION

The present invention relates to the sport of lacrosse and, more particularly, to a padded lacrosse stick.

Lacrosse is a full contact team sport played on a lacrosse field using lacrosse goals, lacrosse sticks, and a lacrosse ball. Offensive team players compete to shoot the ball into an opposing team's goal, wherein the ball moves from player to player by way of each player's lacrosse stick adapted to catch and throw the ball. The lacrosse stick has a triangular shaped rim (called a "lacrosse head") attached to the end of a handle, or shaft. Most lacrosse sticks are made of metal and plastic. The lacrosse head is strung with netting (called "mesh") that allows the ball to be caught, carried, passed, or shot. The players can use the lacrosse stick to control the ball and to strike opposing players' sticks for dislodging the ball netted therein.

Lacrosse is a moderate-risk sport with most injuries that occur during play considered minor. Some of the more serious injuries that can occur during play include concussions and contusions to the head, face, and other parts of the body. Organized lacrosse has rules that require players to wear a certain amount of protective gear. Although the protective gear is required and to a degree effective, injuries still occur during governed matches.

Lacrosse is growing in popularity, especially among children and teenagers, and is played more frequently by people who may be considered novices. Amateur players, understandably, may not fully understand the game and its potential to cause injury. Additionally, amateur play is increasingly done in an ad hoc, recreational manner sometimes with only the equipment essential to play the game. As such, protective gear may not be included in amateur or recreational play. Regardless of protective gear or not, injuries can and do still occur.

Protective gear, such as lacrosse pads and helmets, is expensive, heavy, bulky, and makes learning the game difficult for both inexperienced and younger players. These disadvantages are a deterrent for some would-be lacrosse players, either because they cannot afford the proper equipment or, even if they have the proper equipment, the cumbersome equipment creates a burden to playing a spontaneous and/or casual "pick-up" game of lacrosse in the backyard, park, street, or beach. And, as previously stated, injuries can be sustained playing lacrosse in recreation or organized events when players are properly in full gear, providing a barrier to entry into the sport by protective parents and guardians.

Prior art lacrosse sticks are made of stiff metal and plastics and when a strike is delivered at full force, the impact can cause injury and/or severe pain. Impacts from strikes from stick checks and incidental contact can cause injuries such as bumps, bruises, cuts, lacerations, contusions, and concussions if a player is not wearing full lacrosse padding on their bodies. This is mainly because current lacrosse sticks do not have any padding on the lacrosse stick nor do they have flexible shafts to soften the impact of stick checks and incidental contact.

As can be seen, there is a need for an apparatus for use in lacrosse to reduce the chance of injury during play.

SUMMARY OF THE INVENTION

Presented herein is a padded lacrosse stick having a lacrosse head, a flexible shaft, and a layer of padding operatively associated with both. The padded lacrosse stick is well suited for use in youth sports, amateur league play, and recreational play, eliminating the need for a full set of lacrosse protective gear, thereby encouraging recreational play that is the lifeblood of and a key source of future growth for the sport. Furthermore, the padded lacrosse stick could be used to play lacrosse at other competition levels with other embodiments as discussed below.

The fully manufactured lacrosse head has a separate attachment padded sheath (not fused to head) that covers the lacrosse head. The padding on the head of the stick can be removed by being unstrung from the head and restrung to the user's liking. The lacrosse shaft/handle provides a flex not found in the prior art for further contact dampening and is wrapped in padding.

The padding is positioned on the lacrosse stick in a manner that maintains, or does not restrict or reduce, performance level but functions to minimize or reduce the impact force of a strike. The padding can have one or more layers, with each layer having a defined thickness. The number of layers and the thickness can be based on the level of play. The padding can completely cover the lacrosse stick or partially cover the lacrosse stick. In the case of partial covering, each area(s) covered can have one or more layers, e.g., the edges may need multiple layers.

The head and shaft of the padded lacrosse stick can be made using die casting processes, injection molding processes, 3D printing processes, or any combination thereof. Various materials, e.g., resin(s), aluminum, titanium, steel, or any combination thereof, can be used to make the head and shaft. However, as noted below as well, completely inflexible, or rigid materials that are used for standard lacrosse shafts today (e.g., aluminum, alloy, and scandium) will reduce the protection afforded by the padding to the lacrosse player that is being checked.

The padded lacrosse stick differs from what currently exists. It is the only fully padded lacrosse stick with a flexible shaft for additional contact dampening on the market. Prior art lacrosse sticks do not use a flexible lacrosse shaft and do not fully cover both the lacrosse head and lacrosse shaft with padding to soften the impact of stick checks and incidental contact.

The present invention is the unique combination of these elements that optimally protects players from the impact of lacrosse stick checking, while still enabling users to play a dynamic game of lacrosse. This combination of features is novel for at least the following reasons: (1) the flexible lacrosse shaft is non-obvious because a rigid lacrosse shaft has been a standard element of lacrosse sticks used in competition due to the weight of the standard lacrosse ball used in competitive gameplay and the defensive stick-checking tactics employed in competitive gameplay, and (2) covering the entire lacrosse head with a padded cover is non-obvious because it can make the scooping, throwing, and catching actions in lacrosse more challenging.

In one aspect of the present invention, a padded lacrosse stick includes the following: a lacrosse head; a flexible lacrosse shaft, wherein the lacrosse shaft is operatively associated with the lacrosse head; a head padding enveloping a substantial portion of the lacrosse head; and a shaft padding enveloping a substantial portion of the lacrosse shaft.

In another aspect of the present invention, the padded lacrosse stick further includes the following: wherein the stiffness of the flexible lacrosse shaft is between approximately 2.28 GPa Young's Modulus (for Acrylonitrile butadiene styrene, ABS) and approximately 3.5 GPa Young's Modulus (for Polyvinyl chloride, PVC) and wherein the standard lacrosse shafts on the market are approximately 74.4 GPa Young's Modulus (for Scandium) or higher (for "Composite"), whereby the lacrosse shaft exhibits greater elastic deformation than standard lacrosse shafts on the market so as to lessen an impact imparted by the lacrosse shaft; a throat connector that operatively associates the lacrosse head to the lacrosse shaft; an elastic connector interconnecting adjacent proximal ends of the head padding; and an end cap joined to a proximal end of the lacrosse shaft so that an outer surface of the end cap is substantially flush with an outer surface of the shaft padding, wherein the head and shaft paddings have a thickness of approximately five millimeters, wherein the substantial portion of the lacrosse head includes a scoop of the lacrosse head, and wherein the stiffness of the lacrosse shaft is less than a stiffness of the lacrosse head.

In other embodiments, the substantial portion of the lacrosse head expressly excludes the scoop, so that a user of the device can use the scoop like a traditional lacrosse head to pick up groundballs. Thus, the 80% of "substantial" covers the remaining portions of the head, while the uncovered scoop portion (in this one embodiment), which is approximately 20% of the total length of the head is not covered by padding.

In another embodiment, a head stiffness of the lacrosse head is substantially greater than the shaft stiffness.

In yet another embodiment, the stiffness of the flexible lacrosse shaft is between approximately the stiffness of Polyvinyl chloride (PVC) and approximately the stiffness of Acrylonitrile butadiene styrene (ABS) and wherein the standard lacrosse shafts on the market are approximately the stiffness of Composite, Aluminum Alloy, and Scandium.

In still yet another embodiment, a Young's Modulus of the lacrosse head is at least 2.7 GPa (as it is made from Nylon Resin, like a standard lacrosse head on the market), and thus the head of the lacrosse stick is generally as stiff as a standard lacrosse head on the market. In other embodiments, the lacrosse head of the present invention has a Young's Modulus of 10 GPa or more. In any event, the shaft of the present invention is much more flexible than a standard lacrosse shaft on the market, thereby the present invention provides 'give' when contact is made between the lacrosse stick and an opponent.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Figure 1:
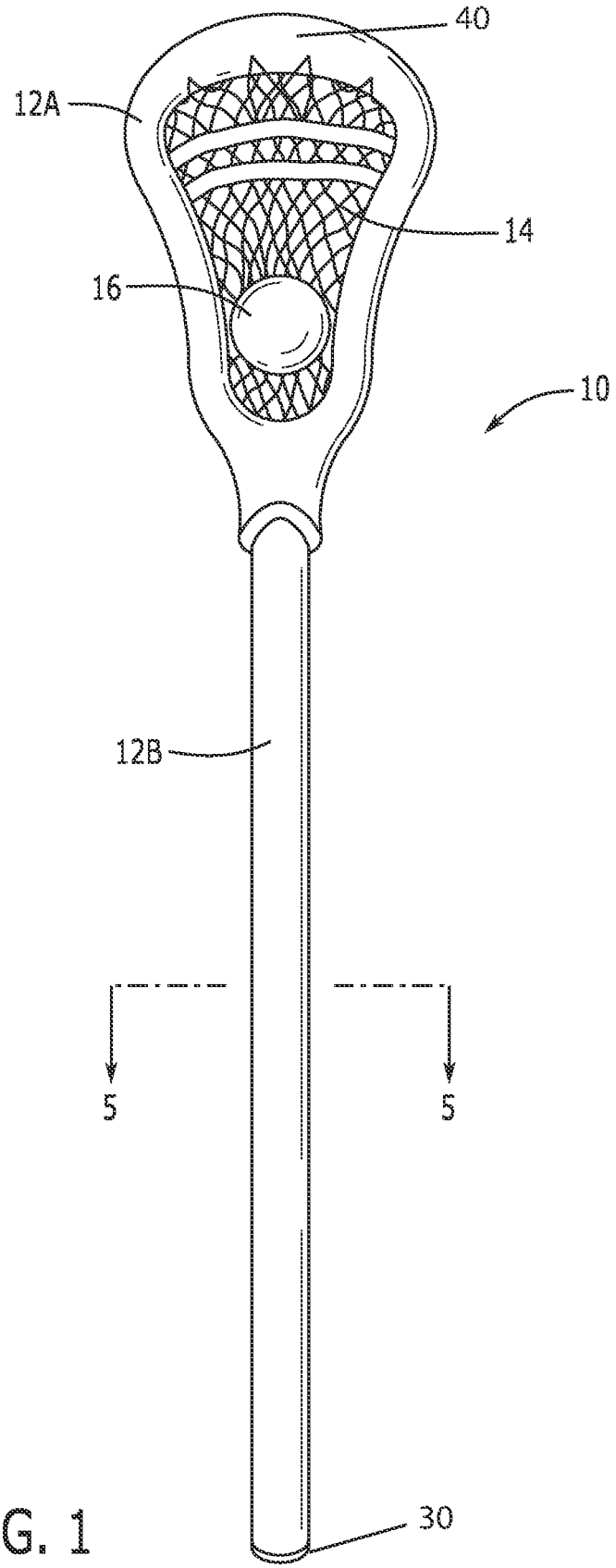
FIG. 1 is a front perspective view of an exemplary embodiment of the present invention.
Figure 2:
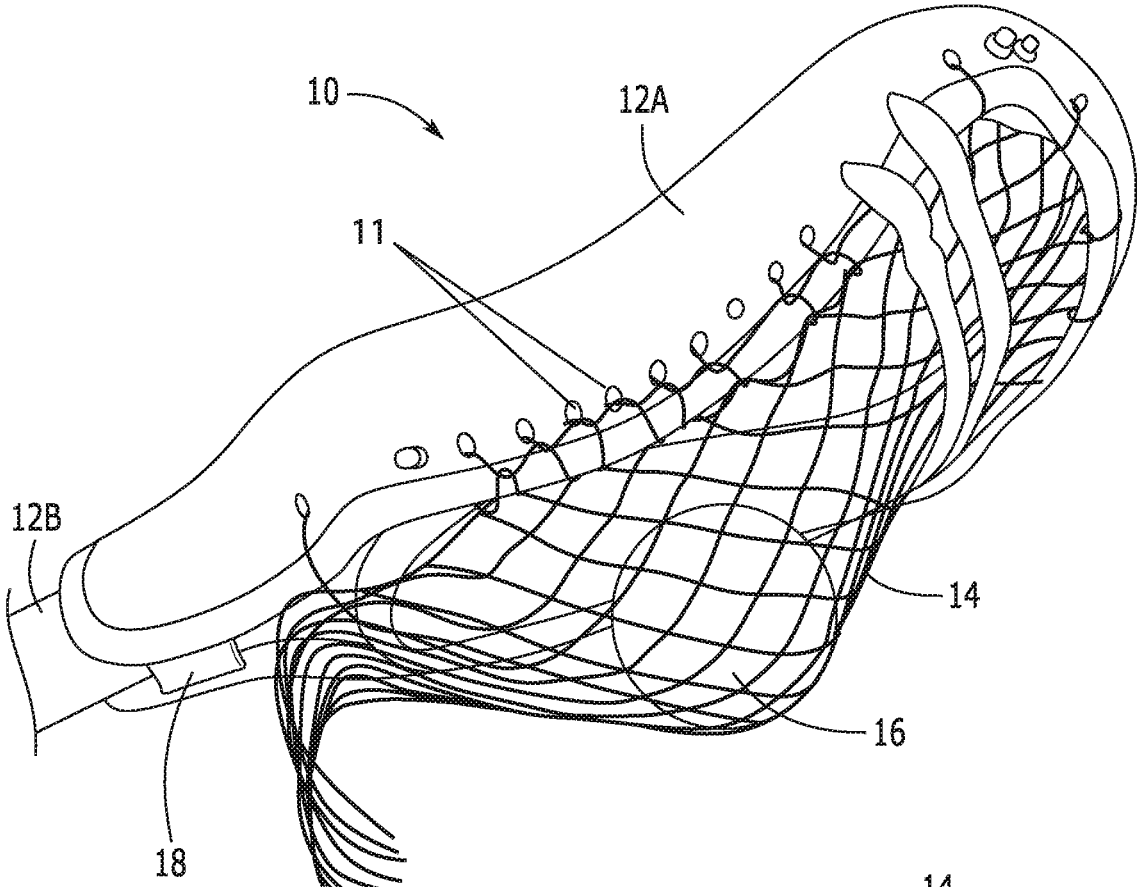
FIG. 2 is a detailed side perspective view of the lacrosse head of an exemplary embodiment of the present invention.
Figure 3:
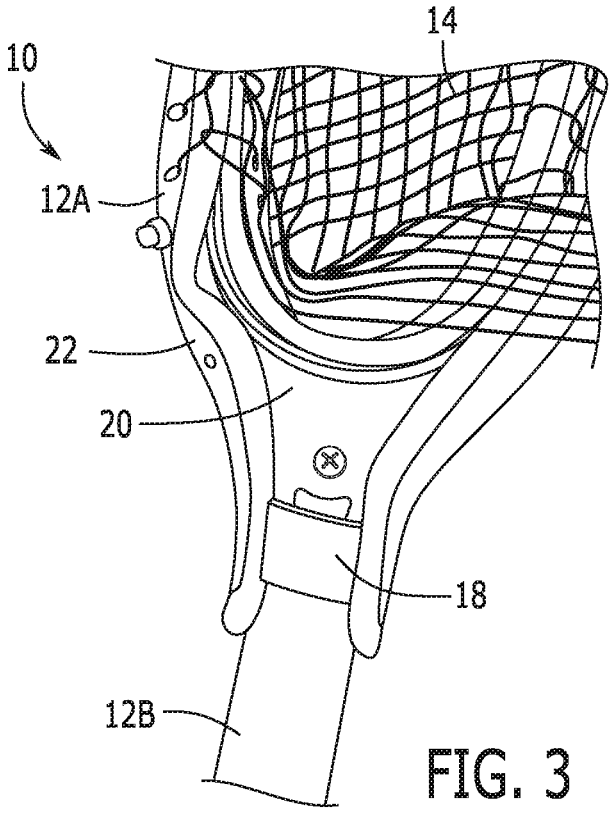
FIG. 3 is a detailed perspective view of an exemplary embodiment of the present invention, illustrating how the padding of the lacrosse head connects.
Figure 4:
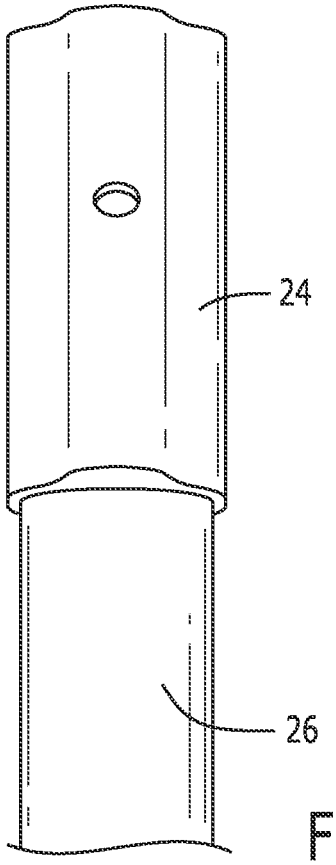
FIG. 4 is a detailed perspective view of an exemplary embodiment of the present invention, illustrating the throat connector 24 and the internal shaft without padding.
Figure 5:
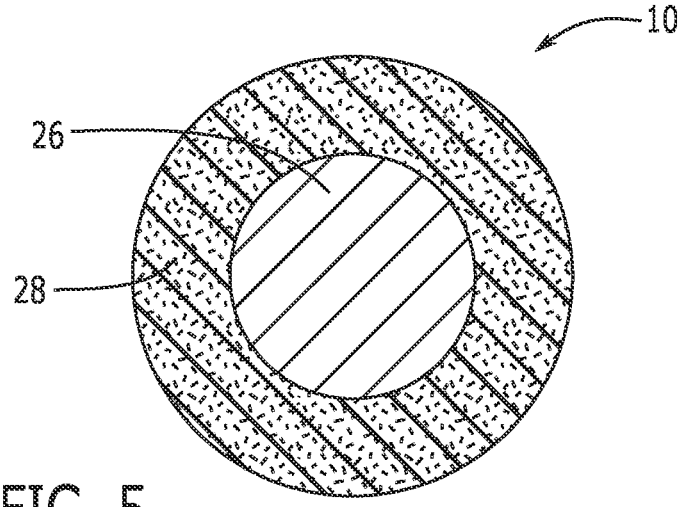
FIG. 5 is a cross-sectional view of an exemplary embodiment of the present invention, taken along line 5-5 in FIG. 1.

Referring to FIGS. 1 through 5, the present invention provides a padded lacrosse stick 10 having a padded lacrosse head 12A operatively associated with a padded lacrosse shaft 12B, wherein the padded lacrosse head 12A is dimensioned and shaped to facilitate the catching, handling, and throwing of a lacrosse ball 16 by way of the head-strong mesh 14.

The padded lacrosse head 12A is the combination of a lacrosse head 20 sheathed in a lacrosse head padding 22. In one embodiment, an ABS premium universal lacrosse head 20 would be used, but other dimensions can be used. In one embodiment, the lacrosse head padding 22 may include a high-resilience ethylene-vinyl acetate (EVA) foam, or other energy absorbing element, with a thickness 5+/−0.5 mm, with a lacrosse head sheath form factor; though, other materials and dimensions can be used. The lacrosse head padding 22 substantially envelopes/encases the lacrosse head 20. The lacrosse head padding 22 may provide an elastic connector 18 adjacent its proximal ends to securely connect the lacrosse head padding 22 along the exterior of the lacrosse head 20, shaft 26, or interface of both. The lacrosse head padding 22 may provide a series of spaced apart mesh holes 11 for supporting the mesh 14. The mesh 14 may be high-density polyester, but other materials can be used.

The padded lacrosse shaft 12B may be the combination of a relatively flexible internal shaft 26 enveloped in shaft padding 28. The term flexible or flexibility is a relative term in view of the stiff standard lacrosse shafts on the market today, wherein standard lacrosse shafts have a first stiffness greater than the stiffness of the flexible internal lacrosse shaft 26. The flexible internal shaft 26 may be made of polyvinyl chloride (PVC) having a diameter of approximately 20 mm; though it is understood that other materials and dimensions may be used. For the shaft padding 28, a high-resilience EVA foam wrap, or other energy absorbing element, having a thickness of 5+/−0.5 mm may be provided; though, other materials and dimensions can be used. Furthermore, the flexible internal shaft 26 may have an intrinsic weight less than a standard, prior art shaft, wherein the addition of the weight of the shaft padding 28 results in the padded lacrosse shaft 12B having a weight approximately the same as the equivalent prior art or regulation shaft of similar length/girth. Accordingly, the selection of the shaft padding 28 and the flexible internal shaft 26 may be governed by this combined weight characteristic.

A throat connector 24 may operatively associate with the flexible internal shaft 26 to the lacrosse head 20. The throat connector 24 may be an aluminum alloy collar with dimensions of approximately 4.55 cm length and an approximately inner 2 cm diameter; though, other materials and dimensions may be used depending on the shaft and head sizes.

Opposite the throat connector, an end cap 30 may be joined to the proximal end ("butt-end") of the flexible internal shaft 26. The outer diameter of the end cap 30 is larger than the outer diameter of the flexible internal shaft 26, so that the former is substantially flush with the shaft padding 28 encasing the flexible internal shaft 26.

A method of making the present invention may include the use of plastic molding techniques, additive manufacture, or other means of manufacturing to form the lacrosse head 20, the flexible internal shaft 26, and the end cap 30. The end cap 30 may be joined (e.g., adhesive) to the proximal end of the flexible internal shaft 26, though in some embodiments the end cap 30 and flexible internal shaft 26 could be a unitary construction. Then, the shaft padding 28 is attached with adhesive to outer surface of the flexible internal shaft 26, thereby wrapping the shaft padding 28 around the flexible internal shaft 26 until the latter is completely encased. The throat connector 24 is attached with adhesive to the distal end of the flexible internal shaft 26. The lacrosse head padding 22 is attached to the top of the lacrosse head 20 by slipping the former over the latter so that the lacrosse head 20 is fully covered by the lacrosse head padding 22. The mesh 14 is then strung through the mesh holes 11 of the lacrosse head padding 22 and associated holes (not shown) of the lacrosse head 20. Then the padded lacrosse head 12A is then attached to throat connector 24, which may have already been attached to the flexible internal shaft 26 and secured with a fastener 32 to form the padded lacrosse stick 10.

Once the padded lacrosse stick 10 is assembled, it can be used to throw and catch a lacrosse ball 16. It can also be used to check the stick or body of opposing players to attempt to dislodge the ball from the stick of an opposing player.

All elements are necessary. There may be opportunities to make the overall padded lacrosse stick lighter by adjusting the materials. We could also consider making the padding less thick at the top of the lacrosse head, the scoop 40, to make it easier to scoop lacrosse balls off the ground.

Depending upon the age, skill-level, size, and preferences of the player, the dimensions of the product materials and even the materials themselves can be adjusted. For example, one could consider making the shaft longer to create a long pole defensive lacrosse stick or simply creating a longer version for larger players. The shaft can also be lengthened, and a goalie lacrosse head can be used to create a padded goalie lacrosse stick. The dimensions of a women's lacrosse stick can also be used for the head and shaft to create a padded women's lacrosse stick. One could also make the lacrosse head bigger to make it easier to throw and catch a larger ball or the head can be made smaller to make the stick lighter for a smaller player. Another adjustment would be deepening the mesh pocket to make it harder for the ball to be dislodged from the stick. One could change the mesh style as well to optimize for different shooting or passing techniques. The padding could be thickened or thinned based on how much protection the player wants from stick checks. One could use different padding materials as well, for instance, a foam that is fully waterproof could be used for a padded lacrosse stick that is meant to be played in water.

One could use a stiffer shaft (e.g., ABS, composite, scandium, aluminum alloy) instead of the PVC shaft which flexes to play with a heavier ball, however, the stick checks may be more impactful without the flexibility of the flexible internal shaft 26. If one wanted to use a standard lacrosse shaft without any padding (e.g., made with aluminum alloy), one could remove padding from the shaft but keep the padding on the head to get some protection from stick checks that use the head, while providing players with the ability to use a standard lacrosse shaft.

For any of the embodiments, a lacrosse player can use the padded lacrosse stick 10 to cradle, throw, and catch the ball 16 when on offense. The lacrosse player can use the padded lacrosse stick 10 to check or hack opponents when playing defense to attempt to dislodge the ball.

The padded lacrosse stick 10 can also be used to create training tools for lacrosse, so that coaches or defensive players can safely check offensive players without causing pain but can still simulate game play.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A padded lacrosse stick comprising:

a lacrosse head having a head frame that defines a head opening, wherein the lacrosse head is configured to support a catching element within the confines of the head opening;

a lacrosse shaft, wherein the lacrosse shaft is operatively associated with the lacrosse head; and a head padding attached to the head frame so as to expose the head opening during use.

2. The padded lacrosse stick of claim 1, further comprising:

wherein a shaft stiffness of the lacrosse shaft is defined, at least in part, by the lacrosse shaft having a Young's Modulus that ranges between approximately 2.28 GPa Young's Modulus and approximately 3.5 GPa.

3. The padded lacrosse stick of claim 2, wherein a head stiffness of the lacrosse head is defined, in part, by a Young's Modulus between 5 and 10 GPa.

4. The padded lacrosse stick of claim 1, further comprising:

a throat connector that operatively associates the lacrosse head to the lacrosse shaft.

5. The padded lacrosse stick of claim 1, further comprising:

an elastic connector interconnecting adjacent proximal ends of the head padding.

6. The padded lacrosse stick of claim 1, further comprising:

a shaft padding encasing at least eighty percent of an uninterrupted length of the lacrosse shaft; and an end cap joined to a proximal end of the lacrosse shaft so that an outer surface of the end cap is substantially flush with an outer surface of the shaft padding.

7. The padded lacrosse stick of claim 6, wherein the head and shaft paddings have a thickness of approximately five millimeters.

8. The padded lacrosse stick of claim 1, wherein the head padding covers a scoop of the lacrosse head.

9. The padded lacrosse stick of claim 1, wherein the head padding has a series of perforations enabling the catching element to be attached to the lacrosse head.

10. The padded lacrosse stick of claim 1, wherein the head padding is attached to at least two-thirds of the head frame.

11. The padded lacrosse stick of claim 1, wherein the head padding is attached to opposing longitudinal edges of the head frame.

12. The padded lacrosse stick of claim 11, wherein the head padding wraps around each of the opposing longitudinal edges of the head frame.

13. The padded lacrosse stick of claim 1, wherein the catching element is a catching mesh configured to catch and throw an object within the head opening.

14. A padded lacrosse stick comprising:

a lacrosse head having a head frame that defines a head opening, wherein the lacrosse head is configured to support a catching element within the confines of the head opening;

a lacrosse shaft, wherein the lacrosse shaft is operatively associated with the lacrosse head; and wherein a shaft stiffness of the lacrosse shaft is defined, at least in part, by the lacrosse shaft having a Young's Modulus that ranges between approximately 2.28 GPa Young's Modulus and approximately 3.5 GPa.

15. The padded lacrosse stick of claim 14, wherein a shaft padding encases at approximately eighty percent of an uninterrupted length of the lacrosse shaft.

16. The padded lacrosse stick of claim 15, further comprising:

an elastic connector interconnecting adjacent proximal ends of a head padding encasing at least two-thirds of the lacrosse head so as to expose the catching element during use.

17. The padded lacrosse stick of claim 16, wherein the head and shaft paddings have a thickness of approximately five millimeters.

18. The padded lacrosse stick of claim 15, further comprising:

an end cap joined to a proximal end of the lacrosse shaft so that an outer surface of the end cap is substantially flush with an outer surface of the shaft padding.

19. The padded lacrosse stick of claim 14, wherein a head stiffness of the lacrosse head is defined, in part, by a Young's Modulus between 5 and 10 GPa.

20. The padded lacrosse stick of claim 14, further comprising:

a throat connector that operatively associates the lacrosse head to the lacrosse shaft.

* * * * *